US007468046B2

(12) United States Patent
Takashima

(10) Patent No.: US 7,468,046 B2
(45) Date of Patent: Dec. 23, 2008

(54) IMPEDANCE-MATCHED VIBRATION MASSAGER

(75) Inventor: Mitsuru Takashima, Tokyo (JP)

(73) Assignee: M.I. Laboratories Corporation, Tokyo (JP)

( * ) Notice: Subject to any disclaimer, the term of this patent is extended or adjusted under 35 U.S.C. 154(b) by 0 days.

(21) Appl. No.: 11/047,908

(22) Filed: Feb. 1, 2005

(65) Prior Publication Data

US 2005/0203446 A1 Sep. 15, 2005

(51) Int. Cl.
*A61H 1/00* (2006.01)

(52) U.S. Cl. ..... 601/46

(58) Field of Classification Search ..... 601/17, 601/46; 600/438, 459
See application file for complete search history.

(56) References Cited

U.S. PATENT DOCUMENTS

| | | | | |
|---|---|---|---|---|
| 4,554,927 | A * | 11/1985 | Fussell | 600/483 |
| 5,456,116 | A * | 10/1995 | Lew | 73/661 |
| 6,511,427 | B1 * | 1/2003 | Sliwa et al. | 600/438 |
| 2005/0148908 | A1 * | 7/2005 | Skover et al. | 601/17 |
| 2005/0148910 | A1 * | 7/2005 | Skover et al. | 601/46 |

FOREIGN PATENT DOCUMENTS

| | | |
|---|---|---|
| JP | 5450180 | 4/1979 |
| JP | 58138455 | 8/1983 |
| JP | 5914854 | 1/1984 |
| JP | 5925728 | 2/1984 |
| JP | 5993533 | 6/1984 |
| JP | 62231663 | 10/1987 |
| JP | 6327639 | 11/1994 |

* cited by examiner

*Primary Examiner*—Michael A. Brown
(74) *Attorney, Agent, or Firm*—Robert D. Katz; Cooper & Dunham LLP

(57) ABSTRACT

A hand-held massager capable of self-excited, impedance-matched vibration for optimal massaging of each particular body part of each particular individual. The massager includes a hollow, open-ended contact piece to which is coupled a vibrator and which is to be held against a desired body part. A pressure sensor is mounted to the contact piece for sensing pressure variations in the cavity in the contact piece while the open end thereof is held against the body part, in order to ascertain the mechanical impedance of that body part. A closed-loop, electropneumatic vibration control system makes it possible for the mechanical impedance to be fed back to the vibrator, causing the latter to make self-induced vibration. Thus the desired body part is optimally massaged at its resonance frequency.

6 Claims, 4 Drawing Sheets

IMPEDANCE-MATCHED VIBRATION MASSAGER

BACKGROUND OF THE INVENTION

This invention relates to massagers in general and, in particular, to those of self-excited vibration variety. More particularly, the invention pertains to a hand-held massager featuring a closed-loop electropneumatic vibration control system for positive feedback of the mechanical impedance of the object of massaging (usually, some body part) to a vibrator. This vibrator is therefore self-excited to vibrate at a resonance frequency of the object and hence to massage the same at the frequency optimal to that particular object.

Vibrating massagers, having a mechanically vibrating part or parts to be held against desired body parts, are well-known. In designing a massager, one can ascertain the resonance frequency of the mechanical impedance of a particular body part, and massage the object at that frequency. See Japanese Unexamined Patent Publication No. 58-138455, which discusses attaching both acceleration and pressure sensors to the part that is to be held against the body. The mechanical impedance of the desired body part is obtained by sweeping the frequency of vibration, and the vibrator is driven at the resonance frequency of the mechanical impedance that has been computed and memorized after the measurement.

In Japanese Unexamined Patent Publication No. 2001-252325, a sensor rather than a vibrator is held against the desired object for impedance measurement. The mechanical impedance of the object is positively fed back from the sensor to the vibrator thereby causing the latter to vibrate at the desired resonance frequency.

Japanese Unexamined Patent Publication No. 6-327639 discusses how to measure the elasticity or like parameter of a human skin surface using a hollow vibrator.

The first cited patent application, teaching to sweep through an expected range of vibration frequencies for determining the resonance frequency of the desired object seems undesirable because the resonance frequency is susceptible to substantive variation depending upon how the vibrator contacts the body surface. The one being massaged is thoroughly restrained during measurement, and not allowed to move. In event he or she does move, moreover, the resonance frequency must be recalibrated.

An additional objection arises from the necessity of mounting the sensors in close proximity of that part of the massager which makes direct contact with the human body. Being most exposed and most often held against the human body, this part is most susceptible to impairment or damage, both physically and chemically. The sensors positioned close to such a vulnerable part are easy to suffer impairment or total destruction, demanding much time and cost for upkeep.

In Japanese Unexamined Patent Publication No. 2001-252325, in which the resonance frequency is automatically renewed by positive feedback, the sensor is not united with the massager. However, one must fasten the sensor to the desired body part either with heavy-duty double-sided adhesive tape or with a belt. Use of such tape or belt is not only troublesome and time-consuming but may cause skin irritation. Certain limitations are imposed, moreover, upon the posture of the user. Furthermore, the sensor carries live current, and therefore poses an additional risk to the user.

SUMMARY OF THE INVENTION

The present invention seeks to overcome all such drawbacks and inconveniences of prior devices and provide an improved vibrating massager incorporating a closed-loop vibration control system such that the mechanical impedance of a desired body part is positively fed back to the vibrator thereby causing the latter to vibrate and massage the object at the resonance frequency of that particular object.

Briefly, the invention may be summarized as a self-excited, impedance-matched vibration massager. It includes a hollow contact piece driven by a vibrator for massaging a desired object by being held against the same. A pressure sensor is mounted to the contact piece, either directly or indirectly, by via a flexible air conduit, for sensing pressure variations in the hollow or cavity in the contact piece while the latter is held against the object, in order to ascertain the mechanical impedance of the object. An electric circuit is connected between the pressure sensor and the vibrator for positively feeding back the mechanical impedance of the object to the vibrator. The vibrator is therefore self-excited into vibration at a resonance frequency of the object, causing the contact piece to massage the object at that frequency.

Preferably, the contact piece takes the form of a cup with an open end. The pressure sensor may be mounted either internally or externally of the contact piece and, when mounted externally, communicated with the interior of the contact piece via a flexible conduit. There is no need for attaching the pressure sensor to the object or even positioning the sensor close to the object, the sensor being required to sense air pressure inside the contact piece. Even when mounted internally of the contact piece, the pressure sensor may be positioned most spaced from its open end to avoid direct contact with the object and resulting contingencies.

The user may simply manually hold the contact piece against the desired part of his or her body. The vibrator, which may be of one-piece construction with the contact piece, will then be self-excited into vibration at a resonant frequency of the desired body part.

BRIEF DESCRIPTION OF THE DRAWINGS

The foregoing objects, features and advantages of the present invention will become more apparent, and the invention itself will best be understood, from a study of the following description and appended claims, with reference had to the attached drawings showing the preferred embodiments of the invention, in which:

DESCRIPTION OF THE PREFERRED EMBODIMENTS

Figure 1:
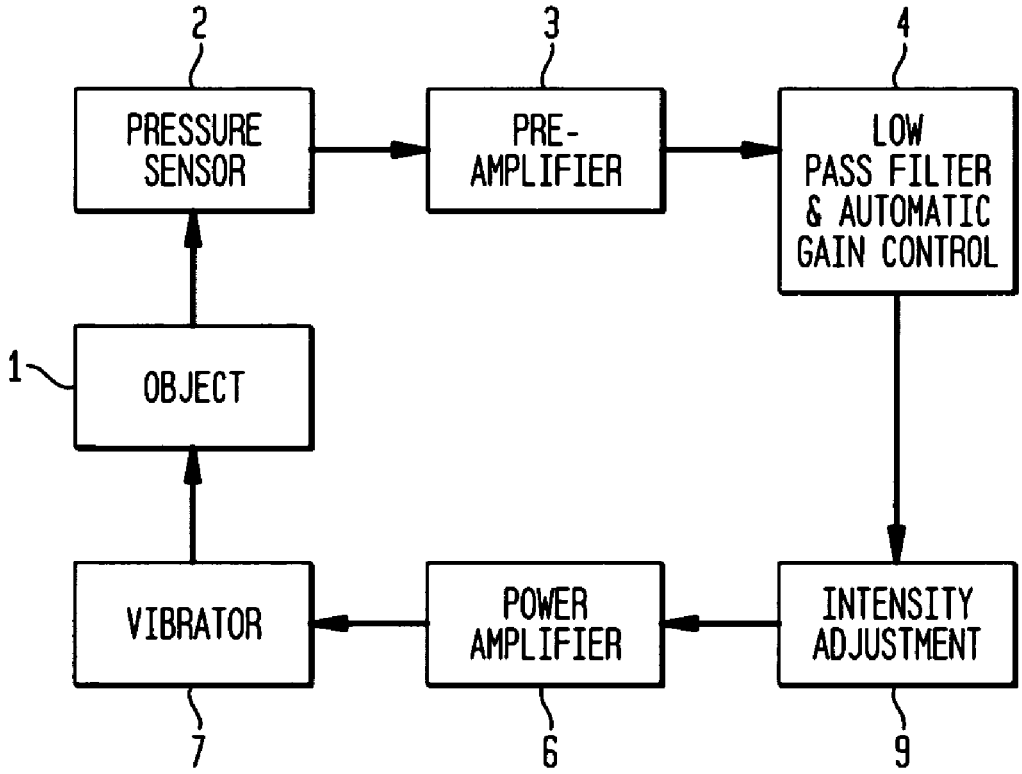
FIG. 1 is a block diagram of the closed-loop, electropneumatic vibration control system which is set up in use of the massager embodying the present invention.

The massager according to the invention is built upon the self-excited, positive-feedback, mechanical-impedance-matched vibration control system diagrammed in FIG. 1. Indicated at 1 in this diagram is the object of massaging which usually is some part of the human body. A pressure sensor 2 is installed at or adjacent a hollow, open-ended contact piece, not shown in FIG. 1, of the massager which is to be held against the object 1. In practice the pressure sensor 2 may take the form of any such known devices as the omnidirectional microphone, piezoelectric converter, or semiconductor device capable of translating pneumatic pressure variations into an electric signal. Chosen from among any such conventional contrivances, the pressure sensor 2 is herein used to sense variations in the pneumatic pressure of the cavity defined by the contact piece as the latter is held against the object 1, as will be subsequently detailed with reference to FIG. 2.

The pressure sensor 2 has its output connected through a preamplifier 3 to a low-pass filter (LPF) and automatic grain control (AGC) circuit 4. As the name implies, the LPF/AGC circuit 4 passes the predefined low-frequency component of the preamplifier output and holds its output signal level constant.

Connected to the output of the LPF/AGC circuit 4, an intensity adjustment circuit 5 permits the user to adjust the intensity of vibration. The intensity-adjusted vibration signal is delivered via a power amplifier 6 to a vibrator 7 causing the same to vibrate at the required frequency and desired intensity for massaging the object 1.

Figure 2:
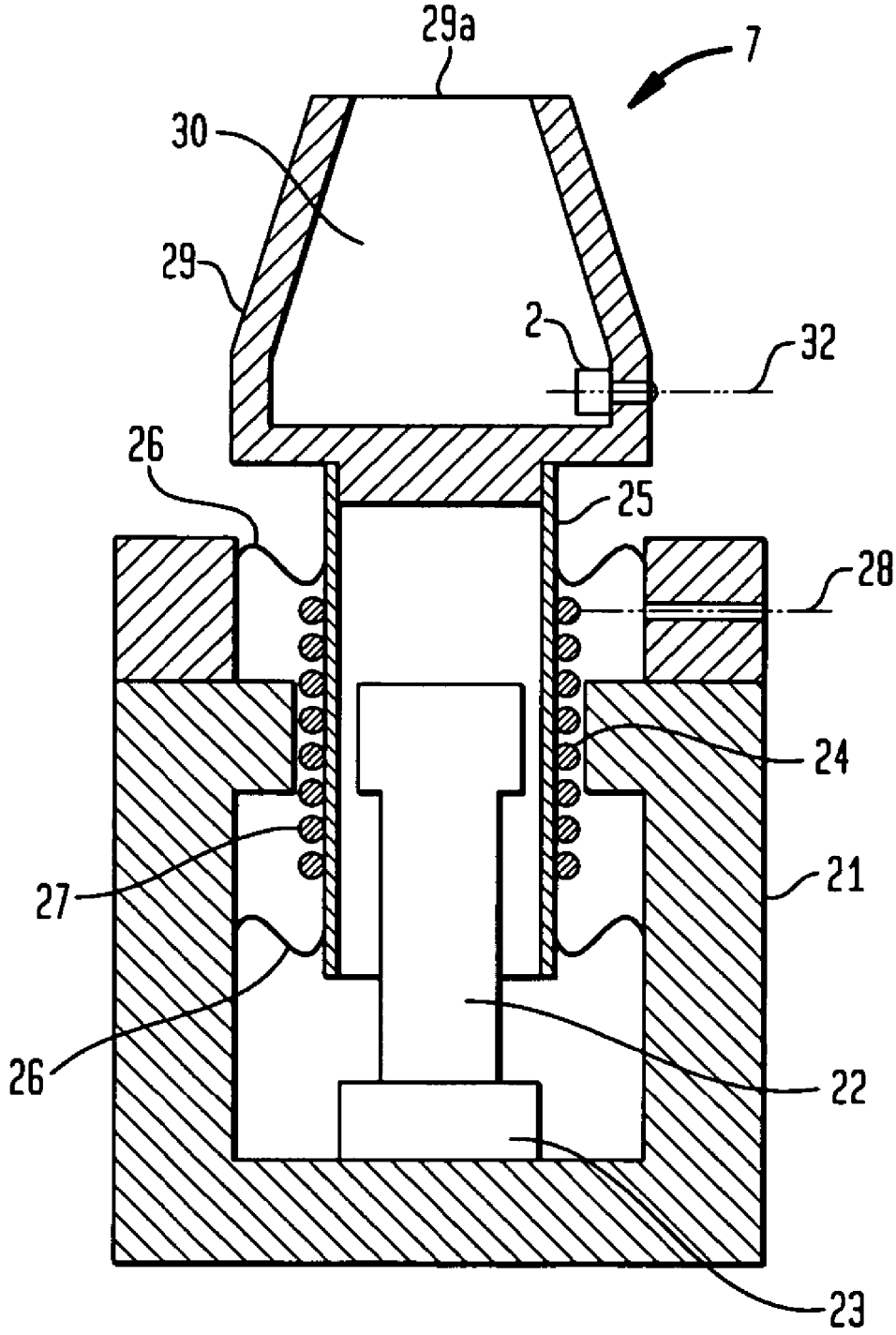
FIG. 2 is an axial section through a preferred embodiment of self-excited vibration massager according to the invention.

The vibrator 7 has the electromechanical construction depicted in FIG. 2.

Thus the electropneumatic vibration control system of FIG. 1 forms a positive feedback loop for self-excited and impedance-matched vibration. Massaged by the vibrator 7, the object 1 has its vibration detected by the pressure sensor 2. The output from this pressure sensor 2 is amplified by the preamplifier 3, then processed as aforesaid by the LPF/AGC circuit 4, and then directed into the intensity adjustment circuit 5 which adjusts its output level to the preset intensity of vibration to be applied. The output from the intensity adjustment circuit 5 is amplified by the power amplifier 6, and the output from this amplifier applied to the vibrator 7.

The signal indicative of the vibration of the desired part of the user's body is positively fed back as above to the vibrator 7 for self-induced vibration. The vibrator 7 vibrates with the intensity that has been determined by the intensity adjustment circuit 5 for massaging the object 1, and with a frequency that is the resonance frequency of the object.

The resonance frequency depends upon the body part to be massaged. Generally speaking, it is of the order of several hertz for the abdomen (and chest as well in the case of women), ten-odd hertz for limbs, and several tens of hertz for the shoulder. Although the self-excited positive-feedback vibration control system of FIG. 1 was explained in terms of analog circuits, a person of ordinary skill could digitize at least part of the system, as by connecting the output of the preamplifier to an analog-to-digital converter.

Reference may be had to FIG. 2 for an understanding of the electromechanical configuration of the vibrator 7. FIG. 2 omits the casing, palm grip and other appendages which are all deemed unnecessary for the understanding of the instant invention.

A yoke 21 of high permeability magnetic material in the shape of a hollow cylinder, closed at one end and open at the other. The yoke 21 has a pole 22 of the same material mounted coaxially therein with clearance 24, and against the closed end of the yoke 21 by a permanent magnet 23. Loosely and concentrically received in the clearance 24 is a hollow coil bobbin 25, which is supported by the yoke 21 by pliant bobbin carriers 26 for axial displacement or vibratory motion without touching the yoke 21 or pole 22. The coil 27 wound around the bobbin 25 has leads 28 for electrical connection to the power amplifier 6, see FIG. 1.

The aforesaid cup-shaped contact piece 29 is mounted to one end of the hollow coil bobbin 25 projecting from within the yoke 21. The contact piece 29 defines a cavity or hollow 30 which is open to the atmosphere via an open end 29*a* of the contact piece 29 to be held against any desired part of the body. Mounted in the hollow 30 of the contact piece 29, and in a position perhaps most distanced from the open end 29*a*, is the pressure sensor 2 forming a part of the electropneumatic vibration control system shown in FIG. 1. The pressure sensor 2 is electrically connected to the preamplifier 3, FIG. 1, by conductors 32 extending outwardly of the contact piece 29.

In use, the user may press the open end $\mathbf{29}_a$ of the cup-shaped contact piece 29*a* against any desired part of his or her body. Thereupon the skin will bulge out into the cup cavity 30 thereby hermetically closing the same. Pressure variations in the cup cavity 30 can now be translated into an electric signal by the pressure sensor 2; that is, the mechanical impedance of the body part in question is now detectable. The positive-feedback vibration control system of FIG. 1 will operate to cause the desired body part to be massaged at the maximum displacement frequency of the skin part confined in the cup cavity 30.

There may be prepared a set of cup-shaped contact pieces of different sizes, particularly of the cavity ends $\mathbf{29}_a$ of different diameters. A contact piece with a cavity end as small as 15 millimeters in diameter, for instance, will make the resonance frequency of the confined skin area very high. The open end of the contact piece will make maximum displacement with a low resonance frequency of 20 hertz or so. Such a contact piece will suit the massaging of relatively large areas such as the thighs or abdomen.

Another example of contact piece, with a cavity end as great as 50 millimeters, will cause vibration with a frequency of several tens of hertz, such that the body part bulging into the cup cavity will undergo a maximum change in radius of curvature. Such a contact piece will be good for massaging relatively small areas such as those of the face. It can, moreover, treat such parts purely pneumatically.

Figure 3:
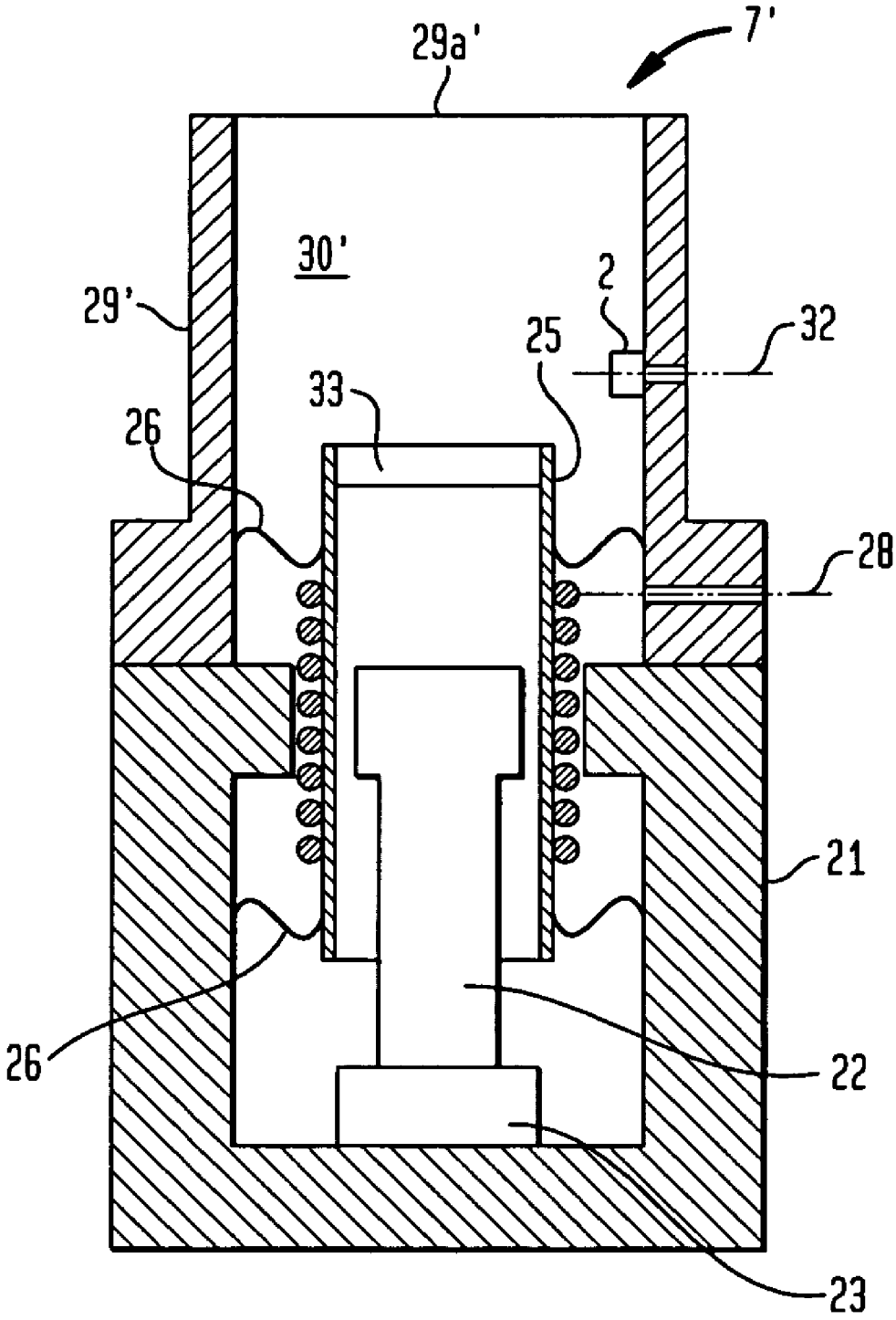
FIG. 3 illustrates another preferred embodiment of the massager according to the invention.

FIG. 3 is an illustration of another preferred form of vibrator 7' which differs from its FIG. 2 counterpart in having a tubular contact piece 29' coaxially mounted to the yoke 21 in end-to-end abutment. The other end 29*a'* of the contact piece 29' is open. Whereas the contact piece 29' is thus itself restrained from displacement relative to the yoke 21, the coil bobbin 25 is free to travel relative to the yoke and the contact piece. Partly received with clearance in the contact piece 29', the coil bobbin 25 is hermetically closed at one end by a diaphragm 33. The pliant bobbin carriers 26 are also of air-tight construction in this embodiment in order to discommunicate the contact piece cavity 30' from the interior of the yoke 21. All the other details of construction are as previously set forth with reference to FIG. 2.

The cavity 30' of the contact piece 29' will be hermetically closed as its open end 29*a'* is pressed against the skin of the desired body part. Then, as the vibration control system of FIG. 1 is set into operation, the diaphragm 33 on the coil bobbin 25 will vibrate to create variations in the air pressure in the contact piece cavity 30'. Such pressure variations will be uniformly applied only to that part of the skin which is confined in the contact piece cavity 30'. The mechanical impedance obtained in this case is therefore representative of only the skin part confined in the contact piece cavity 30', so that this embodiment is best adapted for massaging localized parts of the body.

The massagers built according to the present invention may also be used to massage parts of the body through the clothes in order to avoid baring the user's skin in public. Cavities 30 and 30' of the contact pieces 29 and 29' in FIGS. 2 and 3 would not be hermetically closed should their open ends 29*a* and

29*a*' be held against a part of the body covered with clothing. The mechanical impedance of the desired body part might not be correctly ascertained then.

A remedy to this problem is to close the open ends 29*a* or 29*a*' of the contact pieces 29 and 29' with an airtight, or semi-airtight, cap or film or sheet. The mechanical impedance obtained in this case, however, will be not only of the desired body part but of the combination of the body part, the clothes and the cap or the like. Use of thin, pliant and lightweight caps or the like is therefore recommended in order to minimize their effect upon measurement of the mechanical impedance.

Figure 4:
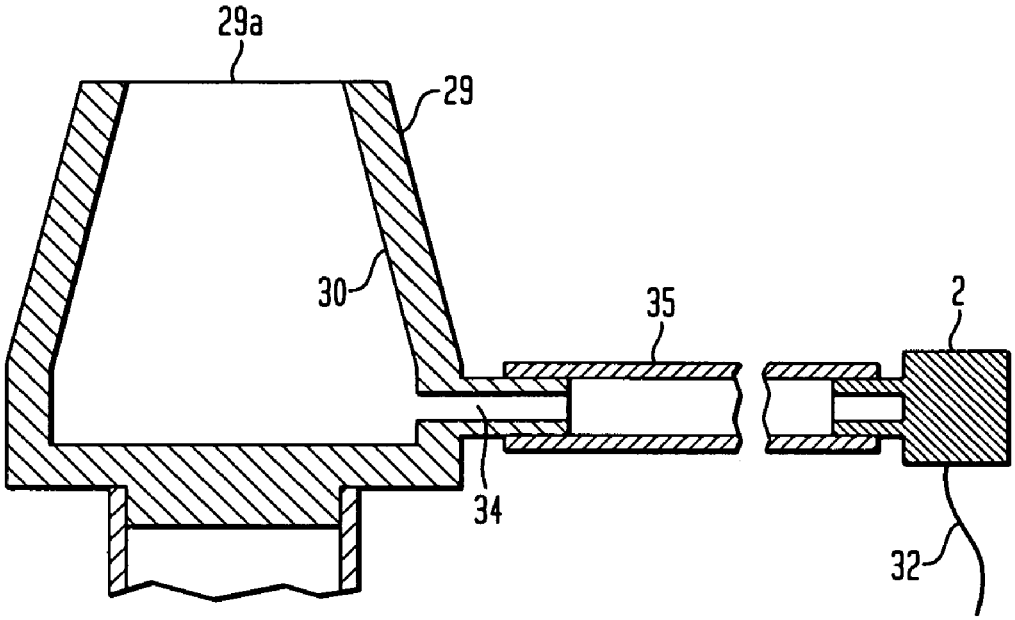
FIG. 4 is a slightly enlarged, fragmentary axial section through a modification of the massager of FIG. 1.

FIG. 4 shows an alternative method of mounting the pressure sensor 2 to the contact piece 29 which is shown in FIG. 2. As shown in FIG. 4, the pressure sensor 2 is installed externally of the contact piece 29. This contact piece has projecting therefrom a short tube 34 in open communication with the cavity 30'. A flexible conduit 35 is airtightly coupled at one end to the tube 34 and has the pressure sensor 2 airtightly attached to the other end thereof. The pressure sensor 2 is electrically connected to the preamplifier 3. See FIG. 1, by the conductors 32 as in the foregoing embodiments.

Thus, mounted outside the contact piece 29 and communicated with its interior via the flexible conduit 35, the pressure sensor 2 is totally free from the mechanical vibration of the contact piece. It can nevertheless remotely sense the internal pressure variations of the contact piece.

Although the present invention has been hereinbefore described in terms of some exemplary embodiments thereof, the invention permits a variety of modifications on the basis of this disclosure. For example, the contact piece may be modified into elongated, tapered or other shapes to adapt itself to the body parts of various positions and shapes to be massaged. Also, an assortment of contact pieces, or contact piece tips, of different shapes and sizes may be prepared for interchangeable use, thereby adapting a single vibrator for use on body parts of widely different surface areas, positions and contours.

It is recognized, moreover, that the massager of this invention lends itself to uses other than massaging. Such additional or ancillary uses include the detection of the resonance frequencies and viscosity resistances of objects such as sponge, rubber and meat products, which all have surfaces just as smooth, pliant and flexible as the human skin. Important parameters of these products, the resonance frequencies and viscosity resistances are measurable by holding the vibrator against their surfaces.

Therefore, it should be understood that various modifications may be made without departing from the spirit of the invention, and that its scope be determined by the following claims.

What is claimed is:

1. A self-excited, impedance-matched vibration massager comprising:

(a) a contact piece to be held against an object to be massaged, the contact piece having a cavity formed therein with an open end for allowing entry of a portion of an object;

(b) a pressure sensor at or adjacent to the contact piece for sensing pressure variations in the cavity in the contact piece when the contact piece is held against the object, in order to ascertain the mechanical impedance of the object;

(c) a vibrator drivingly coupled to the contact piece to transmit vibrations to massage the object; and (d) a self excited feedback vibration control electric circuit connected between the pressure sensor and the vibrator for positively feeding back the mechanical impedance of the object to the vibrator;

(e) whereby the vibrator vibrates at a resonance frequency ranging from several hertz to several tens of hertz, the contact piece to massage the object at a desired resonance frequency.

2. A self-excited, impedance-matched vibration massager as defined in claim 1, wherein the pressure sensor is mounted in the cavity in the contact piece.

3. A self-excited impedance-matched vibration massager as defined in claim 1, further comprising a flexible conduit through which the pressure sensor is coupled to the contact piece in communication with the cavity.

4. A self-excited impedance-matched vibration massager as defined in claim 1, wherein the contact piece is coupled to the vibrator so as to be thereby wholly vibrated.

5. A self-excited impedance-matched vibration massager as defined in claim 1, wherein the contact piece is so coupled to the vibrator that the latter applies vibration only to the air in the cavity in the contact piece.

6. A self-excited, impedance-matched vibration massager as defined in claim 1, wherein the contact piece has an open end through which the cavity is open to the atmosphere, the cavity being substantially hermetically closed when the open end of the contact piece is held against the object.

* * * * *